US011247800B2

(12) United States Patent
Tautz et al.

(10) Patent No.: US 11,247,800 B2
(45) Date of Patent: Feb. 15, 2022

(54) PRESS-ON DEVICE WITH MOTOR

(71) Applicant: Multivac Marking & Inspection GmbH & Co. KG, Enger (DE)

(72) Inventors: Frank Tautz, Rahden (DE); Markus Dauwe, Hilter (DE); Udo Henrichs, Bielefeld (DE); Andreas Reichert, Lage (DE)

(73) Assignee: MULTIVAC MARKING & INSPECTION GMBH & CO. KG, Enger (DE)

( * ) Notice: Subject to any disclaimer, the term of this patent is extended or adjusted under 35 U.S.C. 154(b) by 281 days.

(21) Appl. No.: 16/354,367

(22) Filed: Mar. 15, 2019

(65) Prior Publication Data

US 2019/0283917 A1 Sep. 19, 2019

(30) Foreign Application Priority Data

Mar. 16, 2018 (DE) ..... 102018204037.0

(51) Int. Cl.
*B65C 9/36* (2006.01)
*B65C 1/04* (2006.01)
*B65C 9/30* (2006.01)

(52) U.S. Cl.
CPC ..... *B65C 1/045* (2013.01); *B65C 1/042* (2013.01); *B65C 9/30* (2013.01); *B65C 9/36* (2013.01)

(58) Field of Classification Search
CPC ..... B65C 1/04; B65C 1/042; B65C 1/045; B65C 9/36
See application file for complete search history.

(56) References Cited

U.S. PATENT DOCUMENTS 1,239,858 A * 9/1917 Woodland ..... B65C 9/36 156/476
2,217,325 A 10/1940 Von Hofe
4,059,477 A 11/1977 Wesley
4,349,405 A * 9/1982 Dudzik ..... B65C 3/14 156/358
6,155,322 A * 12/2000 Landan ..... B65C 1/042 156/541

(Continued)

FOREIGN PATENT DOCUMENTS

EP 2985235 B1 3/2017
GB 2525495 A 10/2015

(Continued)

*Primary Examiner* — Philip C Tucker
*Assistant Examiner* — John Blades
(74) *Attorney, Agent, or Firm* — Brooks Kushman P.C.

(57) ABSTRACT

A press-on device for a labeling machine that presses an adhesive label onto a product package. The press-on device may comprise a slide element as a support for a product package, a conveying unit for conveying a product package along a conveying direction, and a folding element for folding an adhesive label applied to an upper surface of the product package and projecting beyond the package. The press-on device additionally comprises a motor and a press-on unit driven by the motor and moved in a linear movement during operation of the press-on device, the press-on unit being configured to press an end of the adhesive label onto a lower surface of the product package during the linear movement of the press-on unit.

18 Claims, 4 Drawing Sheets

(56) References Cited

U.S. PATENT DOCUMENTS

| | | | | |
|---|---|---|---|---|
| 2008/0303666 | A1* | 12/2008 | Abe | B65C 1/042<br>340/572.1 |
| 2012/0216956 | A1* | 8/2012 | Korthauer | B65C 1/045<br>156/350 |
| 2016/0046401 | A1* | 2/2016 | Riegel | B65C 1/04<br>156/227 |
| 2016/0096647 | A1* | 4/2016 | Austermeier | B65C 9/36<br>156/227 |
| 2019/0256237 | A1* | 8/2019 | Mills | B65C 1/026 |

FOREIGN PATENT DOCUMENTS

| | | | |
|---|---|---|---|
| WO | 2014179829 | A1 | 11/2014 |
| WO | 2018002242 | A1 | 1/2018 |

* cited by examiner

PRESS-ON DEVICE WITH MOTOR

CROSS-REFERENCE TO RELATED APPLICATIONS

This Application claims priority to German Patent Application No. 102018204037.0 filed on Mar. 16, 2018 to Frank Tautz, Markus Dauwe, Udo Henrichs and Andreas Reichert, currently pending, the entire disclosure of which is incorporated herein by reference.

FIELD OF THE INVENTION

The present invention relates to a press-on device for a labeling machine.

BACKGROUND OF THE INVENTION

Food products are often placed or introduced in portions into a thermoformed plastic tray and, subsequently, the tray is sealed in an airtight manner with a plastic film, e.g. using a heat-sealed seam. In order to provide consumers with information on the contents of such a product package, printed labels are additionally applied to the product package. Band- or strip-shaped labels, which may also extend across lateral surfaces of a product package, i.e. which encompass the product package at least partially, are becoming increasingly popular. In this context it is important that the labels are applied straight and wrinkle-free, and that this is done in a flow of goods moving on a production line as fast and as continuously a possible.

SUMMARY OF THE INVENTION

It is the object of the present invention to provide an improved press-on device for pressing an adhesive label onto a product package.

This object may be achieved by a press-on device having the features described herein and by a method for pressing-on an end of an adhesive label also described herein. A press-on device according to the present invention for a labeling machine, used for pressing an adhesive label onto a product package, may comprise a slide element as a support for a product package, a conveying unit for conveying a product package along a conveying direction, and a folding element for folding an adhesive label applied to an upper surface of the product package and projecting therebeyond. The slide element may be a slide plate having a low coefficient of friction, but it may also have rollers or actively driven belts for thus supporting the conveyance of the product package through the conveying unit. Upstream in the conveying section, a device may be provided as part of the labeling machine, the device being configured for applying the adhesive label to the upper surface of the product package. The press-on device additionally comprises a motor, e.g. a servo motor, and a press-on unit driven by the motor and moved in a linear movement during operation of the press-on device. The press-on unit may be configured to press an end of the adhesive label onto a lower surface of the product package using said linear movement. It follows that the product package may arrive at the press-on device with the label disposed on the upper surface of the product package in a substantially horizontal orientation, the projecting part of said label being first folded downwards by the folding element preferably substantially vertically. The folding element may here be a straight or a curved folding strip, a straight or a curved folding rod or a combination of a plurality of such components in the form of a deflection unit. The press-on device then applies the end of the downwardly directed adhesive label onto the lower surface of the product package with a sweeping movement. In the course of this process, the product package rests on the suitably shaped slide element such that, during its movement along the conveying direction, the area of its lower surface, where the adhesive label may be just being pressed on, will always remain free in some embodiments. Thus, a normally narrow, elongated label can extend from an upper surface along a lateral side down to a lower surface of a product package and encompass a product package in this way. With an appropriate design, the adhesive label will serve to present the product in an appealing and informative manner. Making use of the press-on device described here, the pressing of an end of the adhesive label onto the lower surface of the product package can take place while the product package may be being conveyed.

Preferably, the press-on unit may comprise a press-on brush or a press-on roller or a press-on blade. The press-on brush normally comprises elongated bristles arranged along a line of narrow width, which may be directed upwards perpendicularly or at an oblique angle. Preferably, the length of the press-on brush along the conveying direction of the product package corresponds at least to the width of the adhesive label to be pressed on. The same applies to a press-on roller or a press-on blade, but all three components may also be smaller or larger than the width of the adhesive label. Since a transverse relative movement between the press-on unit and the product package may be eliminated due to the described arrangement and control of the press-on unit, a distortion of the label will reliably be prevented.

According to an advantageous embodiment, the press-on unit may be arranged such that the linear movement executed thereby will take place preferably at an angle $\alpha$ of approx. −65° to −75° relative to the conveying direction of the product package. This kind of movement sums up two movements, viz. the movement which may be orthogonal to the conveying direction and to the movement of the product package, respectively, and which serves to brush on the adhesive label and the movement which follows the product package along the conveying direction. It follows that the brushing on of the adhesive label can take place during the continuous movement of the product package in the continuous flow of goods.

According to an expedient embodiment, the press-on unit may be arranged on a carriage supported on a guide, the carriage being connected to the motor or servo motor via a belt. The belt may be here configured e.g. for transmitting a rotary movement of the motor as a linear movement to the carriage and thus to the press-on unit. The belt may be, on the one hand, stationarily connected to the carriage and, on the other hand, it runs over a pulley driven by the rotor of the motor. The press-on unit may be normally releasably connected to the carriage, e.g. by one or a plurality of screw connections, but it may also be formed integrally with the carriage. The use of a servo motor may be particularly advantageous, since its control mechanism allows exact travel distances and speeds. By changing its direction of rotation, a forward and a reverse movement can be generated. If the press-on unit or even only the press-on brush may be releasably attached to the carriage, they can be replaced, so as to use press-on brushes of different sizes or replace press-on brushes that are worn, while the drive components can remain unchanged. Instead of a belt-driven rotary motor, also a linear motor may be used for moving the carriage.

Typically, the guide comprises two parallel, preferably cylindrical rods. The carriage may be supported on the rods via respective openings, e.g. holes, and can be pulled therealong by the belt. The rods may be arranged exactly one above the other in the vertical plane, but they may also be diagonally offset. The use of two parallel rods ensures stable support and guidance of the carriage, the latter being thus stably protected against tilting.

Ideally, the carriage comprises two surfaces, which each extend through an opening of a cover unit. In order to protect the drive components of the press-on unit against dirt, and an operator at the conveying path against moving parts, the drive components may be arranged in a housing. In order to transfer the movement of the carriage from the interior of the cover unit, i.e. the housing, slots or openings are provided in the upper surface of the cover unit. In order to achieve the highest possible rigidity, two parallel surfaces, which are oriented vertically and which extend parallel to the direction of movement, will be of advantage. In this way, the openings in the cover unit can be as narrow as possible, their length being adapted to the necessary travel distance.

According to a preferred variant, the press-on unit may be, at a home position and during the linear movement, oriented at right angles to the product package. As regards the correspondingly arranged press-on brush, this means that its linearly arranged bristles extend substantially along the conveying direction of the product package and, due to the movement of the press-on unit, which takes place orthogonally thereto, the adhesive label will always be brushed on by the entire length of the press-on brush. This guarantees that all the areas of the adhesive label will be pressed onto the lower surface of the product package.

According to a particularly advantageous variant, the home position of the press-on unit may be adjustable for adapting the press-on device to product packages of various sizes. In this way, the starting point of the linear movement can be displaced outwards or inwards in relation to the conveying direction within the limits of the maximum possible travel distance. The end point or turning point may be determined symmetrically thereto. This allows the travel distance to be adapted to the product packages such that it will always be minimal, i.e. just as long as necessary. Hence, the time required for the press-on process will always be kept to a minimum, and this leads to a maximum throughput of product packages.

Preferably, a (servo) motor controller may be configured for controlling the linear movement of the press-on unit such that it has a constant speed $v$ during the press-on process. In view of the fact that the product packages are usually conveyed at a constant conveying speed, it will be advisable to adapt the movement of the press-on brush thereto, so as to prevent an additional disadvantageous relative movement. Hence, acceleration and deceleration takes place before or after the press-on process. In this way, it is guaranteed that the press-on brush will always assume the correct position with respect to the adhesive label. The controller and the motor would, however, also be suitable for realizing a variable speed pattern during the press-on process.

According to an expedient embodiment, the speed $v$ of the press-on unit is $v$=conveying speed/cosine ($\alpha$), at least during part of the press-on process. As described above, $\alpha$ is the angle enclosed by the linear movement of the press-on unit and by the conveying direction of the product package. It follows that, depending on the angle $\alpha$ and the conveying speed of the product package, $v$ is the speed of the press-on unit that is required for executing the press-on movement and for simultaneously following the movement of the product package. In this way, the adhesive label can be pressed on uniformly and completely.

According to a common variant, the (servo) motor controller may be configured such that, after the press-on process, the press-on unit may be moved from a rear end position directly back to the home position. The press-on unit may be therefore decelerated as quickly as possible and, subsequently, directly accelerated to a return movement. Hence, there will be no standstill at the turning position. Since no constant speeds need to be observed during the return movement, an acceleration as quick and as long as possible can take place during this return movement, in order to then, possibly after a phase of constant travel, which is, however, not mandatory, decelerate the press-on unit until it has reached its home position. This allows the travel times to be kept to a minimum and the cycle performance, i.e. the product packages processed per unit time, to be kept to a maximum.

According to a further variant, the conveying unit comprises a head belt for conveying the product package. The head belt may be arranged such that it enters into contact with the product package from above and moves the latter across the slide element of the press-on unit using a frictional force. The materials chosen for the head belt may be materials that establish a particularly high static friction with the product package, such as rubber or rubber mixtures, whereas the slide element should have as low a friction coefficient as possible, as may be the case with polished stainless steel or Teflon, by way of example. Due to the arrangement of the conveying unit above the product package, the lower surface of the product package can remain accessible for pressing on the adhesive label.

Usually, the conveying unit may be configured for conveying the product packages continuously. The product package, which has been labeled from above, may be fed via a conveyor body and transferred to the press-on device. When the conveying speeds of the feeding conveyor body and of the head belt of the press-on unit are equal, the transfer of the product package and the conveyance of the latter within the press-on unit will take place as a continuous movement. To this end, the speed of the conveying unit can be adjusted via a controller. The cycle performance of the press-on unit can thus be synchronized with the other stations of the conveying path and there will be no necessity of providing a collecting or a delay area upstream of the press-on unit.

According to a further variant, the press-on device comprises two press-on units, which, at their respective home position, are arranged on different sides of the press-on device, so as to press a respective end of an adhesive label onto the lower surface of the product package. This allows an adhesive label, which may be disposed on the upper surface of a product package and which projects on both sides, a right and a left side, to be first folded at the respective ends using two folding elements into a substantially vertical orientation, whereupon the ends can be pressed from the left and from the right hand side onto the lower surface of the product package using the two press-on units. It follows that the motion components of the two press-on units orthogonal to the conveying direction are oppositely directed, whereas the motion components along the conveying direction are equal.

According to an expedient embodiment the press-on units are arranged such that the motion paths of their linear movements will not intersect. This can be realized e.g. by arranging the press-on units such that their traveling paths are located one after the other along the conveying direction.

In this way, it may be possible to guide an adhesive label from the upper surface of a product package via two lateral surfaces to the lower surface and to press it then onto said lower surface, i.e. to symmetrically encompass a product package. Likewise, it is possible to apply two adhesive labels, which are e.g. spaced apart on the upper surface, such that they extend via a respective lateral surface down to the lower surface. Either possibility can increase the attractiveness of the goods on sale.

Other aspects and advantages of the present invention will be apparent from the following detailed description of the preferred embodiments and the accompanying drawing figures.

DESCRIPTION OF THE SEVERAL VIEWS OF THE DRAWING

In the following, an advantageous embodiment of the present invention will be explained in more detail making reference to a drawing, in which the individual figures show.

DETAILED DESCRIPTION OF THE INVENTION

Figure 1:
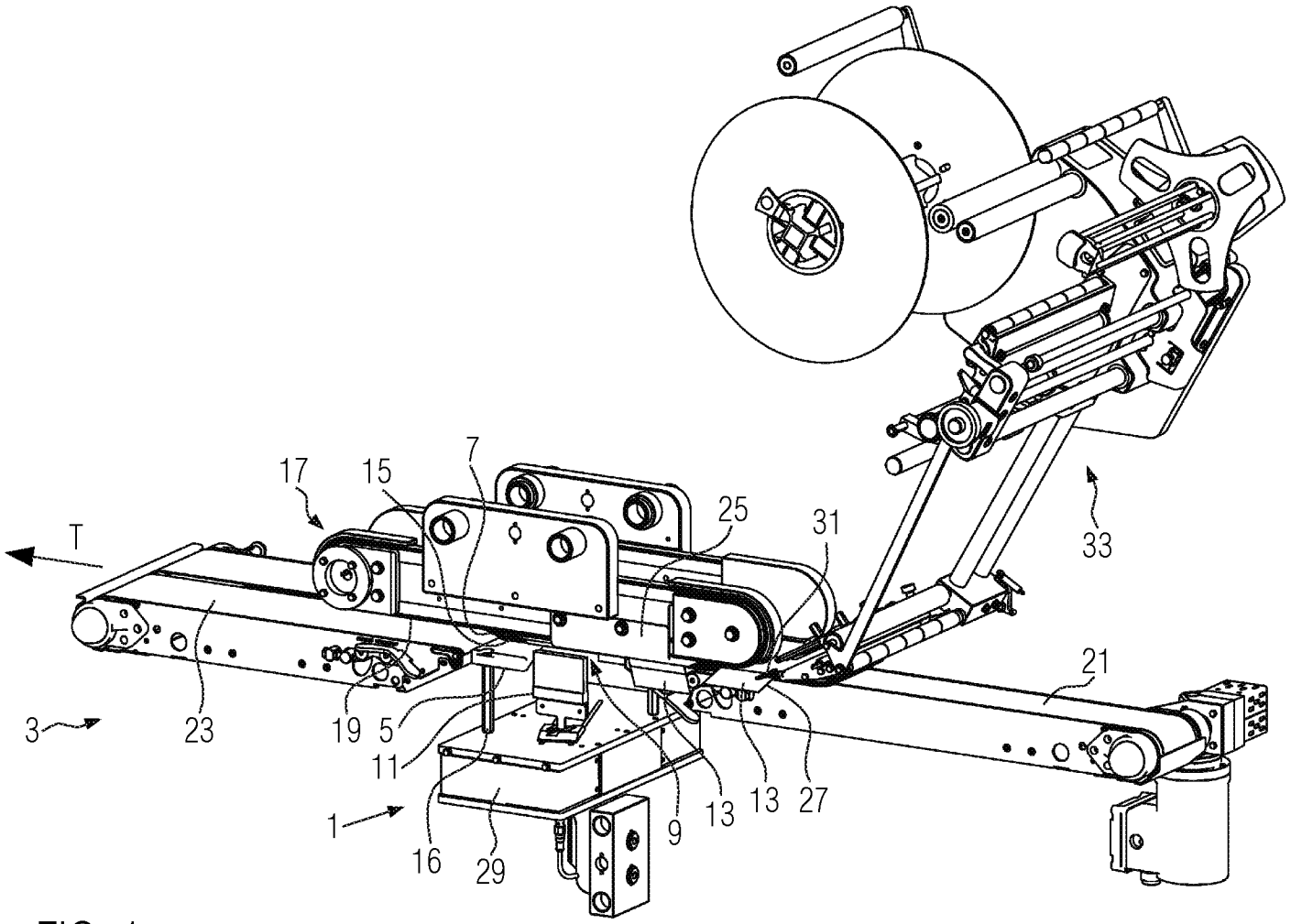
FIG. 1 is a perspective view of one embodiment of a press-on device as part of a labeling machine in accordance with the teachings of the present disclosure.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

FIG. 1 shows a press-on device 1, here exemplarily as part of a labeling machine 3. The press-on device 1 comprises a slide element 5 in the form of a slide plate as a support for a product package 7, with an opening 9, which is sufficiently wide for allowing a press-on unit 11 to press an adhesive label 13 onto a lower surface 15 of the product package 7. The slide element 5 is supported on spacing legs 16 and thus positioned on a desired level. The press-on device 1 comprises a conveying unit 17, which moves the product package 7 along the conveying direction T, for example using two synchronously operated head belts 19, as shown here. A feed belt 21 conveys the product package 7 to the press-on device 1 and a discharge belt 23 carries out further transport when labeling has been completed. A folding element 25 folds a projecting end 27 of the adhesive label 13 into a substantially vertical position, from which it is pressed onto the lower surface 15 of the product package 7 using the press-on unit 11. Drive components of the press-on device 1 are encapsulated within a cover unit 29, i.e. a housing 29. In the present representation, further parts of the labeling machine 3 can be seen in addition to the feed and discharge belts 21, 23. For example, a stripping edge 31 of a label dispenser 33 is used for transferring the adhesive label 13 from a backing tape to the product package 7. What can be seen here is a product package 7 at a first, right position with the adhesive label 13 placed on top as well as at a second position further downstream, with the adhesive label 13 folded downwards, and a third position further downstream, with the adhesive label 13 pressed onto the lower surface 15 of the product package 7.

Figure 2:
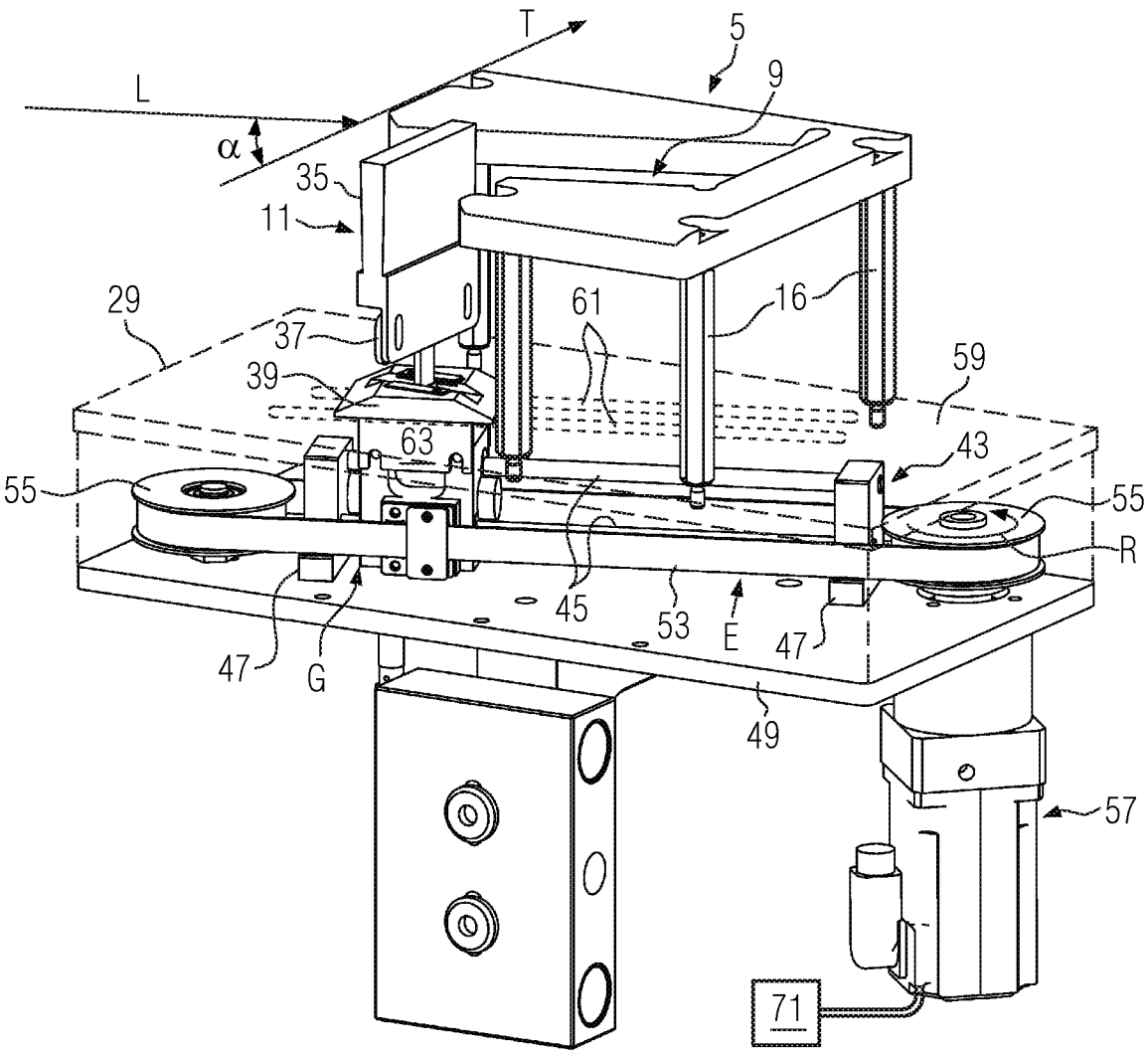
FIG. 2 is a perspective view of numerous components of one embodiment of a press-on device in accordance with the teachings of the present disclosure.

In FIG. 2, components of the press-on device 1 are shown, the cover unit 29 being indicated by a broken line. The slide element 5 can be seen, which comprises the opening 9 oriented at an oblique angle to the conveying direction T and allowing the press-on unit 11 to move therein, at least sectionwise. The press-on unit 11 comprises an elongate press-on brush 35 or press-on roller 35 or press-on blade 35 as well as a connecting piece 37 and is mounted on a carriage 39. The carriage 39 is displaceably mounted on a guide 43. The guide 43 is here configured in the form of two parallel, diagonally offset, cylindrical rods 45, which are fixed to a base plate 49 via two anchoring elements 47. The carriage 39 is fixedly connected to a belt 53 via a connecting piece 51. The belt 53 is tensioned around two pulleys 55, one of which is driven by a motor, e.g. a servo motor 57. The motor 57 is controlled by a controller 71, which is usually an electronic data processing unit. Using the drive component arrangement shown, a rotary movement R of the motor 57 and thus of the pulleys 55 is transmitted as a linear movement L to the press-on unit 11. In an upper side 59 of the cover unit 29, two openings 61 are provided, through which two surfaces 63 of the carriage 39 extend and within which a linear movement L of the carriage 39 is possible. According to the structural conditions, the press-on unit 11 can execute the linear movement L from a home position G to an end position E, the linear movement L being inclined at an angle $\alpha$ relative to the conveying direction T, as shown here by the respective arrows.

Figure 3:
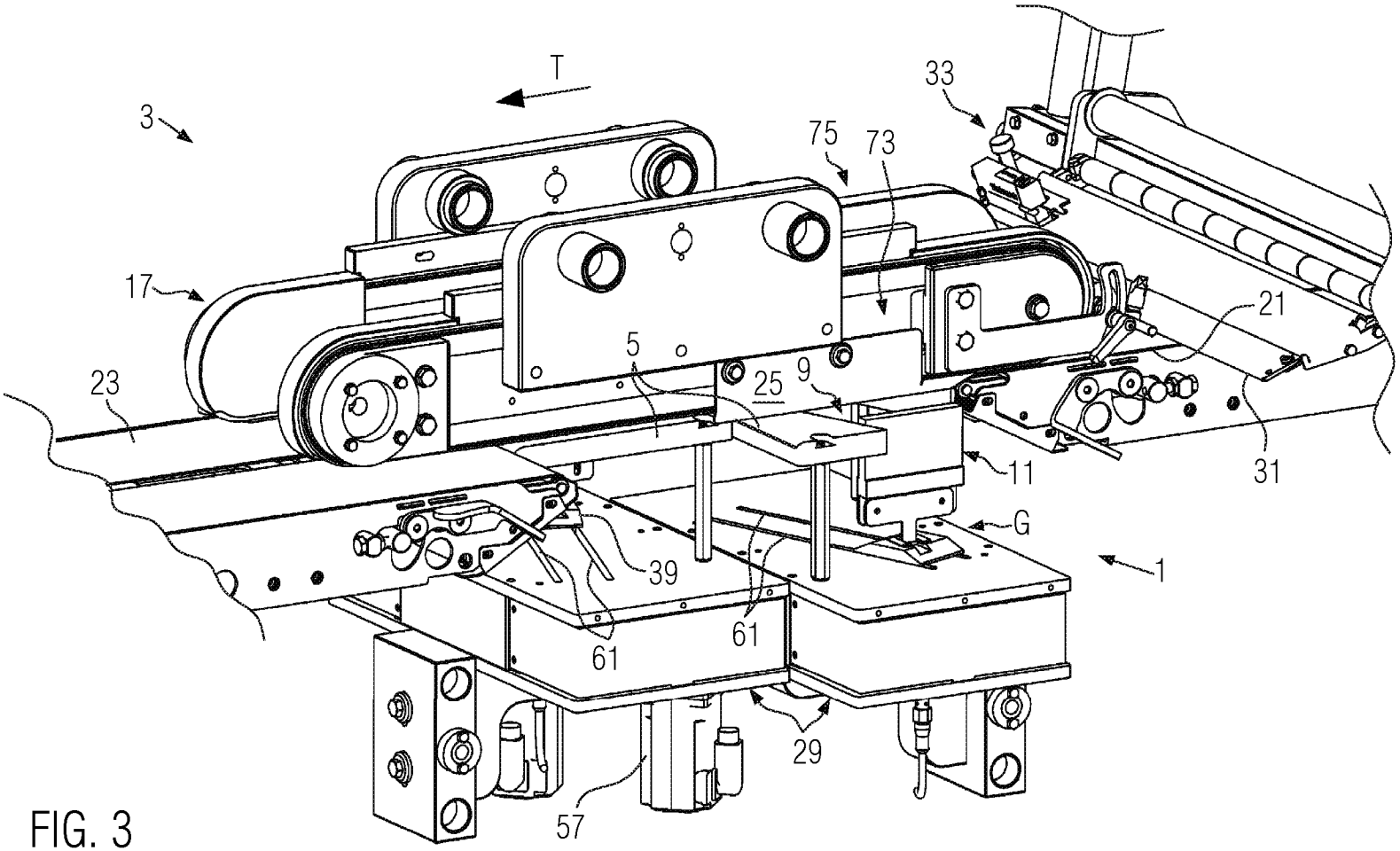
FIG. 3 is a perspective view of one embodiment of a press-on device in accordance with the teachings of the present disclosure, wherein the press-on device is suitable for pressing on two opposed ends of an adhesive label.

FIG. 3 shows a press-on device 1, which is suitable for pressing on two opposed ends of an adhesive label 13. To this end, two slide elements 5 as well as the press-on units 11 associated therewith and the drive components installed within a respective cover unit 29 are arranged below the conveying unit 17. The openings 9 in the slide elements 5 and the openings 61 within the cover units 29 are oriented relative to the conveying direction T such that a left end of an adhesive label 13 is pressed on first and the right end thereof afterwards. The carriage 39 and the press-on unit 11 are here each shown at their home position G, i.e. the starting position prior to the press-on process. The home positions G are here arranged adjacent to a first side 73, i.e. a left side when seen in the conveying direction T, and a second, right side 75. The folding element 25 is here visible for the left side 73, and a corresponding folding element is provided on the opposite, right side 75. Also the label dispenser 33 is shown, in which a backing film is passed over a stripping edge 31 so as to detach the adhesive labels 13 attached to said film and apply them to an upper surface of a product package 7.

Figure 4A:
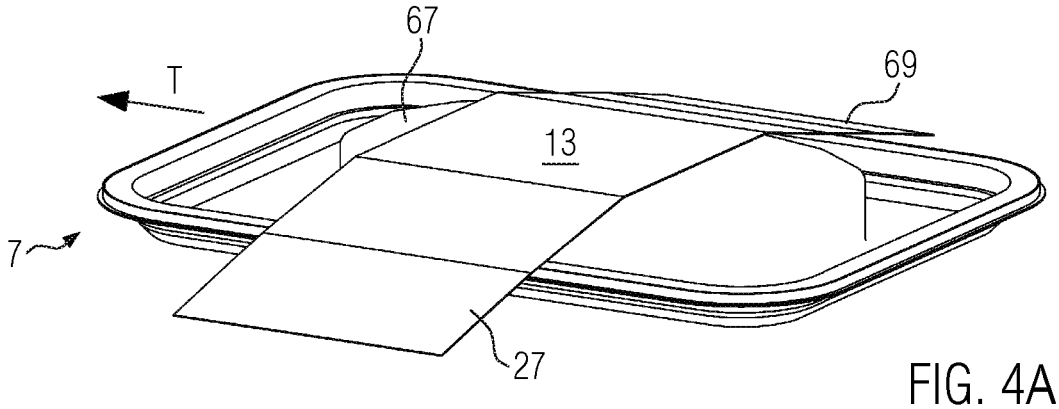
FIG. 4A is a perspective view of one embodiment of a product package showing an adhesive label at a first moment of time on its way through one embodiment of a press-on device in accordance with the present invention.

FIG. 4A shows a product package 7 having an adhesive label 13 applied to the upper surface 67 thereof using the label dispenser 33. In this example, the adhesive label 13 is dimensioned such that a left and a right end 27, 69 project beyond the product package 7, the projecting ends 27, 69 being longer than the height of the product package 7. Alternatively, the adhesive label 13 may also have only one projecting piece, or two adhesive labels 13 each having one projecting piece may be applied.

Figure 4B:
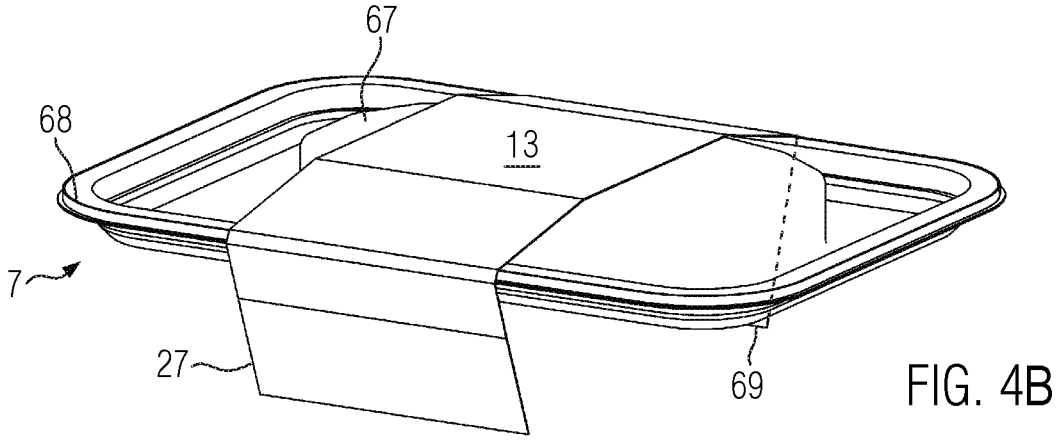
FIG. 4B is a perspective view of one embodiment of the product package of FIG. 4A showing an adhesive label at a second moment of time during application of the adhesive label.

FIG. 4B shows the product package 7 according to FIG. 4A after the two projecting ends 27, 69 of the adhesive label 13 have been folded down in a substantially vertical direction around an upper edge 68 of the product package 7 by folding elements 25 arranged on both sides.

Figure 4C:
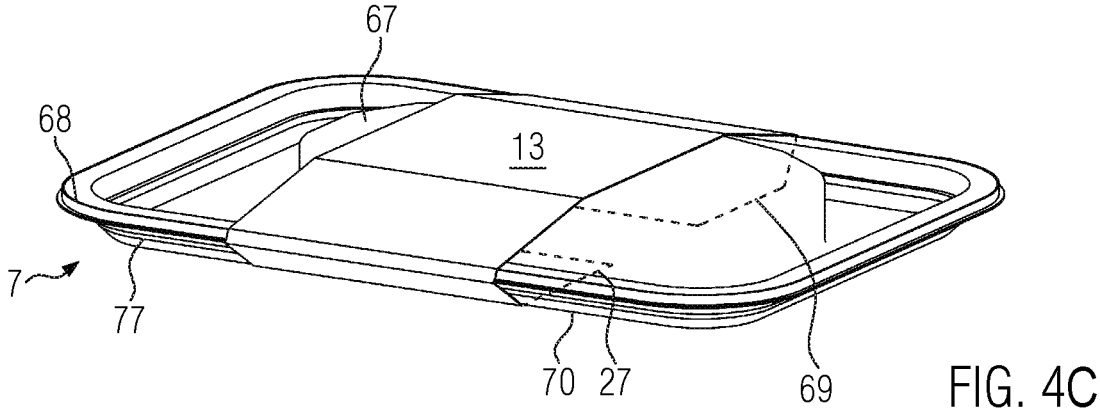
FIG. 4C is a perspective view of one embodiment of the product package of FIG. 4A showing an adhesive label at a third moment of time in a fully applied condition.

FIG. 4C shows the product package 7 of the two preceding figures after the two ends 27, 69 of the adhesive label 13 have been pressed onto the lower surface 15 of the product package 7 using a press-on unit 11. The adhesive label 13 has thus been folded around the upper edge 68 and the lower edge 70 of the product package 7. Since the adhesive label 13 is stably pressed onto the upper and lower surfaces 67, 15 of the product package 7, it will also be possible to label product packages 7 having a laterally projecting upper edge 68, so that the adhesive label 13 will only incompletely be in contact with a lateral surface 77 of the product package 7.

In the following, the method steps for pressing an end 27, 69 of an adhesive label 13 onto a lower surface 15 of a product package 7 will be explained:

According to the present invention, the product package 7 is fed by a feed belt 21 or a comparable device of a conveying unit 17, after an adhesive label 13, which projects beyond the product package 7, has already been applied to the upper surface 67 of the product package 7. The conveying unit 17 then continues to convey the product package 7 along a conveying direction T during the subsequent method steps. Making use of a folding element 25, the projecting end 27, 69 of the adhesive label 13 is folded around an upper edge 68 of the product package 7 and extends then in a substantially vertical direction. Subsequently, the projecting end 27, 69 of the adhesive label 13 is pressed onto a lower surface 15 of the product package 7 using a press-on unit 11. In the course of this process, the press-on unit 11 is driven by a motor, e.g. a servo motor 57, and moved in a linear movement L while the adhesive label 13 is being pressed-on.

Preferably, the linear movement L executed by the press-on unit 11 takes place at an oblique angle, preferably at an angle $\alpha$ of approx. −65° to −75°, relative to the conveying direction T of the product package 7.

In addition, it will be advisable to carry out the linear movement L, which is executed by the press-on unit 11, at a speed $v$=conveying speed/cosine ($\alpha$) during the press-on process.

Taking as a basis the above described embodiments of a press-on device 1, many variations of the latter are possible. For example, the conveying unit 17 may convey the product packages 7 using driver strips instead of a head belt 19. The guide 43, on which the carriage 39 is displaceably supported, may comprise, instead of cylindrical rods 45, also rectangular or polygonal rods, of which a single one may then be sufficient to prevent the carriage 39 from tilting. The carriage 39 may also comprise only a single surface 63, configured e.g. as part of a double T-shape, so as to guarantee sufficient torsional stiffness. Hence, it would also suffice to provide only one opening 61 through which the surface 63 extends. In addition, it would be imaginable to arrange the components of the press-on device 1 vertically, i.e. rotated by 90° relative to the above described embodiments, so that the labels 13 can be pressed onto lateral surfaces of a product package 7 according to the above description.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions and methods described above and illustrated in the drawings are presented by way of example only and are not intended to limit the concepts and principles of the present invention. Thus, there has been shown and described several embodiments of a novel invention.

As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A press-on device for a labeling machine used to press an adhesive label onto a product package, the press-on device comprising:

a slide element as a support for a product package;

a conveying unit for conveying the product package along a conveying direction; and a folding element for folding an adhesive label applied to an upper surface of the product package, wherein the adhesive label projects beyond the upper surface of the product package when the adhesive label is applied to the upper surface of the product package;

wherein the press-on device additionally comprises a press-on unit and a motor to drive the press-on unit, wherein the press-on unit is disposed to travel over a linear movement during operation of the press-on device, the press-on unit is configured to press an end of the adhesive label onto a lower surface of the product package during the linear movement, and the press-on unit is disposed so that the linear movement is in a direction that forms an oblique angle $\alpha$ relative to the conveying direction of the product package and the linear movement is in a plane parallel to the conveying direction, and wherein the motor and the press-on unit are configured so that the press-on unit is able to follow the product package as the conveying unit continuously conveys the product package along the conveying direction.

2. The press-on device according to claim 1, wherein the press-on unit comprises at least one of: a press-on brush, a press-on roller, or a press-on blade.

3. The press-on device according to claim 1, further comprising a carriage disposed on a guide, wherein the press-on unit is arranged on the carriage, the carriage being drivingly connected to the motor via a belt, and the belt is configured to transmit a rotary movement of the motor to a linear movement of the carriage.

4. The press-on device according to claim 3, wherein the guide comprises two parallel rods.

5. The press-on device according to claim 1, wherein the press-on unit is oriented at at least one right angle to the product package at a home position of the press-on unit and during the linear movement of the press-on unit.

6. The press-on device according to claim 5, wherein the home position of the press-on unit is adjustable for adapting the press-on device to product packages of various sizes.

7. The press-on device according to claim 1, wherein the motor comprises a controller to control the linear movement of the press-on unit at a constant speed during a press-on process.

8. The press-on device according to claim 7, wherein during at least part of the press-on process, the speed of the press-on unit equals a conveying speed/cosine ($\alpha$).

9. The press-on device according to claim 7, wherein the controller is operable to cause the press-on unit to move from a rear end position directly back to a home position after the press-on process.

10. The press-on device according to claim 1, wherein the conveying unit is configured to continuously convey the product package.

11. The press-on device according to claim 1, wherein the press-on device comprises an additional press-on unit, wherein the press-on unit and the additional press-on unit are arranged on different sides of the press-on device when the press-on unit and the additional press-on unit are each at a respective home position, and wherein the additional press-on unit is configured to press an additional end of the adhesive label onto the lower surface of the product package.

12. The press-on device according to claim 1, wherein during at least part of a press-on process in which the end of the adhesive label is pressed onto the lower surface of the product package by the press-on unit, a speed of the press-on unit is based on a conveying speed of the product package divided by cosine ($\alpha$).

13. The press-on device according to claim 1, wherein the slide element is configured to support the lower surface of the product package and has an opening for allowing the linear movement of the press-on unit.

14. A method for pressing an end of an adhesive label onto a lower surface of a product package, the method comprising:

applying an adhesive label onto an upper surface of a product package such that the adhesive label has at least one end that projects beyond the upper surface;

conveying the product package along a conveying direction using a conveying unit;

folding the adhesive label around an upper edge of the product package using a folding element;

driving a press-on unit using a motor in a linear movement; and pressing an end of the adhesive label onto a lower surface of the product package using the press-on unit while the press-on unit is being driven in the linear movement;

wherein the linear movement executed by the press-on unit takes place at an oblique angle $\alpha$ relative to the conveying direction of the product package and the linear movement is in a plane parallel to the conveying direction, and wherein the motor and the press-on unit are configured so that the press-on unit follows the product package during pressing as the conveying unit continuously conveys the product package along the conveying direction.

15. The method according to claim 14, wherein the linear movement, which is executed by the press-on unit, is carried out at a speed v equal to a conveying speed/cosine ($\alpha$) during a press-on process.

16. The method according to claim 14 further comprising supporting the product package on a slide element that has an opening for allowing the press-on unit to execute the linear movement.

17. A press-on device for a labeling machine used to press an adhesive label onto a product package, the press-on device comprising:

a conveying unit for conveying a product package along a conveying direction;

a folding element for folding an adhesive label applied to an upper surface of the product package, wherein the adhesive label projects beyond the upper surface of the product package when the adhesive label is applied to the upper surface of the product package;

a press-on unit; and a motor to drive the press-on unit;

wherein the press-on unit is configured to travel over a linear movement during operation of the press-on device, the press-on unit is configured to perform a press-on process to press an end of the adhesive label onto a lower surface of the product package during the linear movement, the press-on unit is configured so that the linear movement is in a direction that forms an oblique angle $\alpha$ relative to the conveying direction of the product package, and, during at least part of the press-on process, a speed of the press-on unit equals a conveying speed of the product package divided by cosine ($\alpha$), and wherein the press-on unit is configured to follow the product package during the press-on process as the conveying unit continuously conveys the product package along the conveying direction.

18. The press-on device according to claim 17 further comprising a slide element configured to support the product package, wherein the slide element has an opening for allowing the linear movement of the press-on unit.

* * * * *